US006329957B1

(12) United States Patent
Shea et al.

(10) Patent No.: US 6,329,957 B1
(45) Date of Patent: Dec. 11, 2001

(54) METHOD AND APPARATUS FOR TRANSMITTING AND RECEIVING MULTIPLE FREQUENCY BANDS SIMULTANEOUSLY

(75) Inventors: Donald Shea, Plano; Mark Cavalier, Sachse, both of TX (US)

(73) Assignee: Austin Information Systems, Inc., Austin, TX (US)

( * ) Notice: Subject to any disclaimer, the term of this patent is extended or adjusted under 35 U.S.C. 154(b) by 0 days.

(21) Appl. No.: 09/183,355

(22) Filed: Oct. 30, 1998

(51) Int. Cl.[7] ..... H01Q 13/00
(52) U.S. Cl. ..... 343/756; 343/776; 343/786
(58) Field of Search ..... 343/776, 756, 343/786, 785; 333/21 A; H01Q 13/00, 13/02, 13/06

(56) References Cited

U.S. PATENT DOCUMENTS

| | | | | |
|---|---|---|---|---|
| 4,041,499 | * | 8/1977 | Liu et al. | 343/756 |
| 4,092,648 | | 5/1978 | Fletcher et al. | 343/782 |
| 5,041,480 | | 8/1991 | Cipolla et al. | 343/725 |
| 5,107,274 | | 4/1992 | Mitchell et al. | 343/756 |
| 5,635,944 | | 6/1997 | Weinstein et al. | 343/776 |
| 5,784,033 | | 7/1998 | Boldissar, Jr. | 343/786 |
| 5,793,335 | | 8/1998 | Anderson et al. | 343/786 |
| 5,818,396 | | 10/1998 | Anderson et al. | 343/786 |

OTHER PUBLICATIONS

Livingston, "Multifrequency Coaxial Cavity Apex Feeds," *Microwave Journal*, Oct. 1979, pp. 51–54.

Bird, "$TE_{11}$ Mode Excitation of Flanged Circular Coaxial Waveguides with an Extended Center Conductor", *IEEE Transactions On Antennas and Propagation*, AP–35, Dec. 1987, pp. 1358–1365.

Profera, "Improvement of $TE_{11}$ Mode Coaxial Waveguide and Horn Radiation Patterns by Incorporation of a Radial Aperature Reactance", *IEEE Transactions On Antennas and Propagation*, AP–24, Mar. 1976, pp. 203–206.

Kraus et al., "A Technique for Obtaining Pattern Symmetry and Low Sidelobes from a $TE_{11}$ Mode Coaxial Radiator," *IEEE Transactions On Antennas and Propagation*, AP–25, May 1977, pp. 365–368.

Koch, "Coaxial Feeds for High Aperature Efficiency and Low Spillover of Paraboloidal Reflector Antennas," *IEEE Transactions On Antennas and Propagation*, AP–21, Mar. 1973, pp. 164–169.

* cited by examiner

*Primary Examiner*—Michael C. Wimer
(74) *Attorney, Agent, or Firm*—Conley, Rose & Tayon, PC; Eric B. Meyertons

(57) ABSTRACT

An antenna feed system capable of simultaneously receiving and transmitting in multiple frequency bands is disclosed. In one embodiment, the feed system comprises a dielectric loading rod, an inner cylindrical waveguide, and one or more outer cylindrical waveguides. The dielectric loading rod lies along a central axis, as do the inner waveguide and outer waveguides. The axis of the inner waveguide and the rod may coincide. Each waveguide may be configured to receive and transmit a different frequency band simultaneously with the other waveguides. In addition, the axes of the outer waveguides also coincide with the central axis. The antenna feed system may further comprise one or more junctions disposed to propagate electromagnet radiation into and out of the inner waveguide and outer waveguides. A method and kit for simultaneously receiving and transmitting in multiple frequencies are also disclosed.

32 Claims, 13 Drawing Sheets

METHOD AND APPARATUS FOR TRANSMITTING AND RECEIVING MULTIPLE FREQUENCY BANDS SIMULTANEOUSLY

The United States Government may possibly retain an interest in this patent application.

BACKGROUND OF THE INVENTION

1. Field of the Invention

This invention relates generally to the field of wireless communications and, more particularly, to satellite antenna feed systems.

2. Description of the Related Art

Satellite communications systems convey information on carrier signals in a number of frequency bands approved for this purpose by regulatory organizations and standards bodies. Among the most widely-used bands are the C-band (3.625–4.200 GHz for downlink, 5.850–6.425 GHz for uplink), X-band (7.250–8.400 GHz), and Ku-band (10.950 to 12.750 GHz for downlink, 14.000–14.500 GHz for uplink).

Turning now to FIG. 1, a typical satellite communications system is shown. For uplink transmission from a ground station 110 to a satellite 109, a data signal (which may be digital or analog) is first sent to a modulator circuit 112 in ground station 110. There, the data signal modulates a carrier signal with a frequency in one of the permitted frequency bands. The modulated carrier signal is then sent to an input port on an antenna feed 102. Antenna feed 102 is typically a waveguide assembly positioned such that its radiated output is efficiently coupled to a system of one or more reflector units 100. Antenna feed 102 acts as a transducer that converts the modulated carrier signal into radiated electromagnetic waves 114 that illuminate the reflector units. The waves are then directed by reflector units 100 to satellite 109.

Downlink transmission from satellite 109 to ground station 110 is commonly received by the same antenna system used for the uplink transmission. The above process is reversed for the antenna system to receive a signal from satellite 109. A modulated carrier transmitted by satellite 109 is first directed by reflectors 100 into antenna feed 102. Antenna feed 102 then acts as a transducer to route the received waves to transceiver 108. A demodulator receives the modulated carrier signal from the receive ports and recovers the data stream transmitted by satellite 109.

One potential limitation with prior art systems is that in order to transmit/receive in all three of the popular frequency bands C, X and Ku, three physically separate antenna feed structures are typically needed. For example, a C-band antenna feed with its own I/O port may be needed for transmitting/receiving in the C-band; an X-band antenna feed with its own I/O port may be needed for transmitting/receiving in the X-band; and a Ku-band antenna feed with its own I/O port may be needed for transmitting/receiving in the Ku-band.

Since three separate antenna feed structures are typically needed, it follows that the data transmission/reception from one parabolic reflector can usually occur only in one frequency band at a time. For example, before data transmission/reception can occur in the C-band, the C-band antenna feed may often be physically moved such that its I/O port is located at the focal point of the parabolic reflector. Then, to switch data transmission/reception to the X-band, the C-band antenna feed is physically moved out of the focal point of the reflector so that the X-band antenna feed can be physically moved to the focal point of the reflector. Consequently, the number of data streams which are transmitted/received simultaneously may be limited to the number of data streams which fit into one frequency band. Having to physically move the C-band, X-band and Ku-band antenna feed structures to and from the focal point of the reflector is a time-consuming and tedious operation. Furthermore, if the movement is not done accurately, misalignment problems between the reflector and the I/O port of the antenna feed structure may occur.

For example, when the I/O port of an antenna feed is misaligned with its reflector, the radiation pattern of the transmitted electromagnetic waves may become distorted. This distortion may in turn interfere with transmissions from other independent sources. Consequently, many ground stations limit their transmissions/receptions to just one of the three bands C, X, and Ku.

It is common to use antennas having paraboloidal reflectors (e.g., reflector 100 in FIG. 1) in applications such as space communications where radio frequency signals in the form of microwave frequency electromagnetic waves are transmitted between an earth station and a satellite or vice versa. Such antennas may be constructed in a prime focus configuration where microwave frequency energy is coupled to a transceiver by an antenna feed mounted near a focal point of the paraboloidal reflector. The antennas may also be constructed in other configurations such as Gregorian or Cassegrain. Doubly-shaped reflectors may be used as well. These configurations use a small hyberboloidal subreflector mounted near the focal point of the paraboloidal reflector, allowing the feed to be placed between the paraboloidal and hyperboloidal reflectors. Paraboloidal reflector antennas are also used in radar and other communications applications as well.

Regardless of the feed configuration or system application, it is the purpose of the feed to connect a transceiver to the paraboloidal reflector. Antennas intended for operation over multiple frequency bands may normally require a corresponding number of multiple feeds and subreflectors. U.S. Pat. No. 4,092,648 to Fletcher, et al., issued May 30, 1978, and assigned to the National Aeronautics and Space Administration of the United States Government, incorporated herein by reference in its entirety, shows a typical multiple-band antenna having a main reflector that diverts energy to a subreflector and then to a flange. The flange is arranged to pass radiation in a first frequency band to a first horn. Energy in a second frequency band is reflected by the flange to an auxiliary reflector. The auxiliary reflector is arranged to feed energy to a second horn.

If operation in more than two frequency bands is required, subreflector, auxiliary reflector, and multiple horn configurations may become more complicated. In some instances, it may be desirable to tilt and rotate the subreflectors about a symmetry axis in order to provide better tracking of the satellite or other signal source. This further complicates construction and operation of the antenna. It is typically desirable to keep the antenna assembly as small and simple as possible.

Various communication systems employ more than one frequency band for electromagnetic signals radiated from a transmitting station to receiving station. An important example of such a communication system is a satellite communication system wherein various bands of signals are transmitted between a satellite above the earth (synchronous orbit) and ground stations on the earth. As previously noted, three such bands of interest are the C band, X band, and Ku band, which together extend over two octaves of the communication frequency spectrum. Within each of the bands, there is frequency space allocated for reception of signals at the satellite and for transmission of signals from the satellite. The C band itself extends over approximately an octave, operates at both linear and circular polarizations, and includes a receive sub-band in the range of 3.625–4.200 GHz and a transmit sub-band in the range of 5.850–6.425 GHz. The X band includes a receive sub-band in the range of 7.250–7.750 GHz (gigahertz), and a transmit sub-band for transmission from the satellite in the range of 7.900–8.400 GHz. The Ku band operates at both linear and circular polarizations, and includes a receive sub-band from 10.950 to 12.750 GHz, and a transmit sub-band of 14.000–14.500 GHz. Collectively, these frequency bands extend over approximately two octaves of the communications spectrum.

Historically, it has been the practice to provide separate antennas for transmission or reception on each of the bands because there is insufficient bandwidth on any one of the antenna systems or terminals to transmit more than one of the bands. In some cases, where bands are close together and, collectively, do not occupy an excessive amount of spectral space, it has been possible to share a plurality of bands on one antenna. However, basically separate antennas have typically been employed for different portions of the spectrum. In particular, there is no adequate single-point antenna feed system which can cover plural octave bandwidths which include the C, X, and Ku bands.

A further problem arises in the case of satellite communication transportable earth stations in that there is a need to minimize the weight of the system. The use of numerous antennas for communication at various frequency bands may defeat this purpose. In addition, it is advantageous to employ a common phase center for all frequencies of radiation transmitted from the earth station and received at the earth station. This is typically lacking when several antenna feeds are mounted at different times upon an earth terminal. Furthermore, changing the feed system for each frequency band and refocusing the feed requires extra time and trained personnel. The same problems exist for an earth terminal at a fixed location that performs the difficult and tedious process of exchanging feeds and refocusing.

The foregoing problems are compounded by the previously described spectral utilization. The C band and the Ku band are commercial satellite bands which are spaced apart in the spectrum and, therefore, facilitate the filtering of signals in the two bands so as to permit transmission on one band without significant interference with signals on the other band. However, in some applications there is a need to employ the X band (which is a military band) in conjunction with the C band. However, due to the fact that the X band is contiguous to the C band, it is difficult to separate the two bands in a common antenna system. Presently available antenna and feed structures appear unable to accomplish this task adequately.

SUMMARY OF THE INVENTION

The problems outlined above may in part be solved by an antenna feed system configured to propagate electromagnetic radiation in a plurality of frequency bands simultaneously. In one embodiment, the antenna feed system comprises a dielectric loading rod, an inner waveguide, and one or more outer waveguides. The dielectric loading rod lies along a central axis, as do the inner waveguide and outer waveguides. The axis of the inner waveguide and the rod may coincide. In addition, the axes of the outer waveguides also coincide with the central axis. The antenna feed system may further comprise one or more junctions disposed to propagate electromagnet radiation into and out of the inner waveguide and outer waveguides.

In another embodiment, the antenna feed system may further comprise one or more external waveguides positioned to propagate electromagnetic radiation to the junction and away from the junction. The external waveguides may propagate linearly and/or elliptically polarized electromagnetic radiation into and out of the junctions. The antenna feed system may further comprise a sub-reflector. The sub-reflector may be positioned outside the waveguides along the central axis so that the sub-reflector may reflect electromagnetic radiation into and out of the waveguides. The sub-reflector may be positioned to further reflect the electromagnetic radiation from the waveguides to a main reflector (and vice versa). In one embodiment, the longitudinal axis of the waveguides may not coincide with the axis of the main reflector. The sub-reflector may also be positioned so that it does not lie on the axis of the main reflector.

In one embodiment, the inner waveguide and outer waveguides may each be configured to propagate electromagnetic radiation in a particular frequency band (e.g., the L band, the S band, the lower C band, the upper C band, the X band, the Ku band, or the Ka band). In another embodiment, the antenna feed system may comprise a plurality of waveguide means, each with an opening, and each configured to simultaneously transmit and/or receive a particular frequency band or sub-band. The antenna feed system may further comprise a means for reflecting electromagnetic radiation to and from the openings of the waveguide means. In this and other embodiments, the antenna system may further comprise a plurality of transceiving means coupled to the waveguide means.

A method for propagating electromagnetic radiation is also contemplated. In one embodiment, the method comprises propagating electromagnetic radiation along a feed. The feed may comprise a plurality of concentric cylindrical waveguides. A different frequency band may be simultaneously received and/or transmitted in each of the plurality of concentric cylindrical waveguides. The electromagnetic radiation may be propagated into and out of the feed a predetermined number of points along the length of the feed and at the end of the feed. The electromagnetic radiation propagated to and away from the points may be linearly and/or elliptically polarized electromagnetic radiation. In some embodiments, the method may further comprise reflecting electromagnetic radiation to and from a main reflector.

An antenna feed system for propagating communication signals in a plurality of frequency bands simultaneously is also contemplated. In one embodiment, the system may comprise at least three cylindrical conductors each having a different diameter and each being coaxially positioned. The antenna feed system may further comprise a fourth cylindrical conductor. The antenna feed system may be configured to transmit and/or receive two, three, or more frequency bands simultaneously.

In one embodiment, the cylindrical conductors may operate in a transverse electric (TE) mode. In another embodiment, the conductors may operate in the $TE_{1,1}$ mode. In one such embodiment, the second third and fourth conductors may form two outer waveguides that propagates electromagnetic waves in the C-band (e.g. the C-band received frequency range and the C-band transmitted frequency range). Similarly, the first and second conductors may form a third waveguide that propagates electromagnetic waves in the X-band frequency range. In one embodiment, the first conductor may form a fourth waveguide that propagates electromagnetic waves in the Ku-band frequency range. A fifth cylindrical conductor may be positioned coaxially with the first through fourth conductors. The fifth conductor may be configured to form a waveguide with the first conductor that propagates radiation in the Ka frequency band.

In one embodiment, the antenna feed system may further comprise a dielectric loading rod. The dielectric loading rod may be constructed of rexalite and may be positioned coaxially within the first conductor. The antenna feed system may further comprise one or more junctions coupled to the conductors. One or more rectangular waveguides may be coupled to the junctions. The junctions and the rectangular waveguide may serve as a transfer mechanism to transfer electromagnetic waves between the waveguides and a plurality of transceivers. In one embodiment, a rotatable flange may be coupled to one of the waveguides. Rotating the flange may change the polarization of the coupled waveguides.

In yet another embodiment, the antenna feed system may further comprise a plurality of polarization circuits. Each polarization circuit may be coupled to one of the waveguides. Each polarization circuit may comprise two waveguide combiners that are coupled to the rectangular waveguides. The waveguide combiners are each configured to receive two input signals from two rectangular waveguides coupled to different positions of a cylindrical waveguide. The combiners are configured to subtract the inputs to create combined signals. A highbred coupler may be included in the system to receive and combine the combined signals and generate an output signal therefrom.

In another embodiment, the antenna feed system may further comprise a choke coupled to an open end of the outer most cylindrical conductor. The choke may be configured to prevent spill over radiation.

A kit for creating an antenna feed system capable of transmitting and receiving a plurality of communication signals and a plurality of frequency bands simultaneously is also contemplated. In one embodiment, the kit may comprise a sub-reflector configured to receive wireless communication signals reflected from a parabolic dish; three or more cylindrical waveguides; and a plurality of junctions. The cylindrical waveguides may be positioned coaxially when each waveguide has a first end that is configured to face the sub-reflector, and each waveguide may be configured to independently and simultaneously convey a particular frequency band. Each junction may be coupled to a second end of the waveguides. The junctions may be configured to couple the waveguide to a plurality of communications transceivers via a plurality of external waveguides.

A method for transmitting and receiving a plurality of wireless communications frequency bands is also contemplated. In one embodiment, the method may comprise: positioning a parabolic dish antenna to receive the plurality of wireless frequency bands from a source; positioning a sub-reflector to reflect the plurality of wireless communications frequency bands from the parabolic dish antenna to a plurality of cylindrical waveguides having different diameters; receiving a first frequency band with the first cylindrical waveguide; and simultaneously receiving a second frequency band with the second cylindrical waveguide. In some embodiments, additional frequency bands (e.g. a third and/or a fourth frequency band) may be simultaneously transmitted and/or received. The method may further comprise changing the polarization of the frequency band received by one of the waveguides by rotating a flange coupled to the waveguide. The method may also comprise adjusting the frequency band received by one of the waveguides by inserting a dielectric loading rod.

A feed for multi-band satellite communications operation is also contemplated. In one embodiment, coaxial waveguides and a subreflector are utilized with dual-offset antennas. The feed design may consist of a formation of coaxial concentric waveguide cavities operating in the $TE_{1,1}$ mode. This mode, normally used in circular waveguide feed design, is also amenable for use in coaxial waveguides. The frequency of operation of this mode, in the coaxial waveguide, is dependent on the dimensions of the inner and outer radius of the waveguide. The cutoff wavelength is related to the ratio of the radii of the inner and outer cylinders.

In one embodiment, the largest, outermost cavities of the feed operate at the C-Band, the central cavities operate at the X-Band, and the innermost cavity operates at the Ku-Band. Because the commercial C-Band SATCOM frequency range covers a spectrum exceeding the operating limits of a single cavity, in one embodiment the feed incorporates two cavities to serve this frequency range, i.e., one for receive (3.4–4.2 GHz), and the other for transmit (5.850–6.650 GHz). The X-Band and Ku-Band frequency ranges, having smaller percentage bandwidths, are each served by a single cavity per band. In some embodiments, orthogonal rectangular waveguides may feed the antenna to permit polarization diversity, obtainable in all bands.

Advantageously, in some embodiments a multi-band antenna feed may provide the capability to operate a satellite antenna in all three frequency bands without the need for manual intervention. Other logistical advantages may also be present, depending upon the implementation, e.g., fewer parts may be used and training requirements may be reduced. In some embodiments, retrofitting existing earth station systems to increase their capabilities may also be possible. For example, the feed may potentially be modified (e.g., by adding, deleting, or changing the size of the coaxial cavities) to include any number of frequency bands up to 100 GHz.

BRIEF DESCRIPTION OF THE DRAWINGS

The foregoing, as well as other objects, features, and advantages of this invention may be more completely understood by reference to the following detailed description when read together with the accompanying drawings in which.

Figure 1:
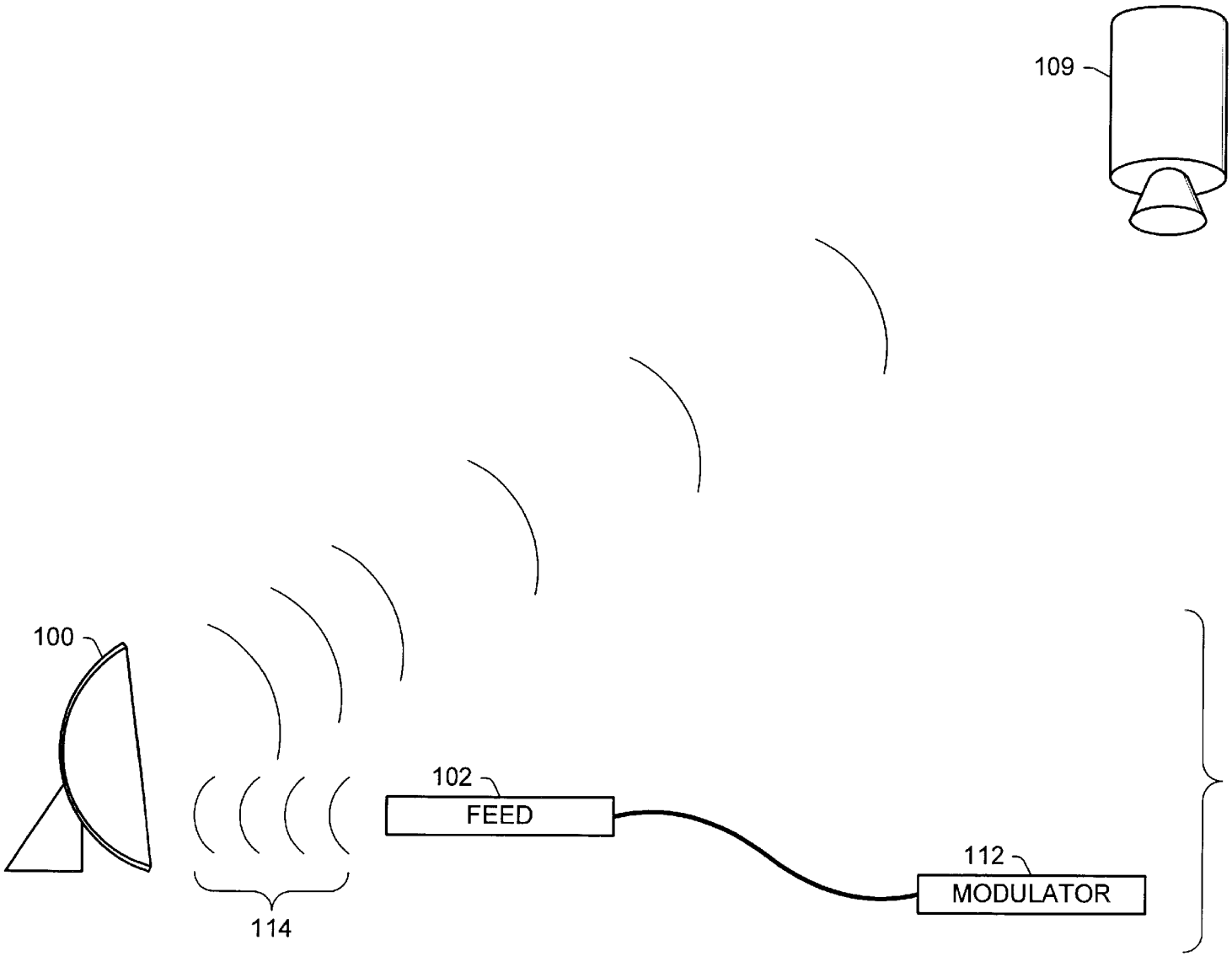
FIG. 1 shows one embodiment of a satellite antenna system.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION OF THE PREFERRED EMBODIMENTS

Figure 2:
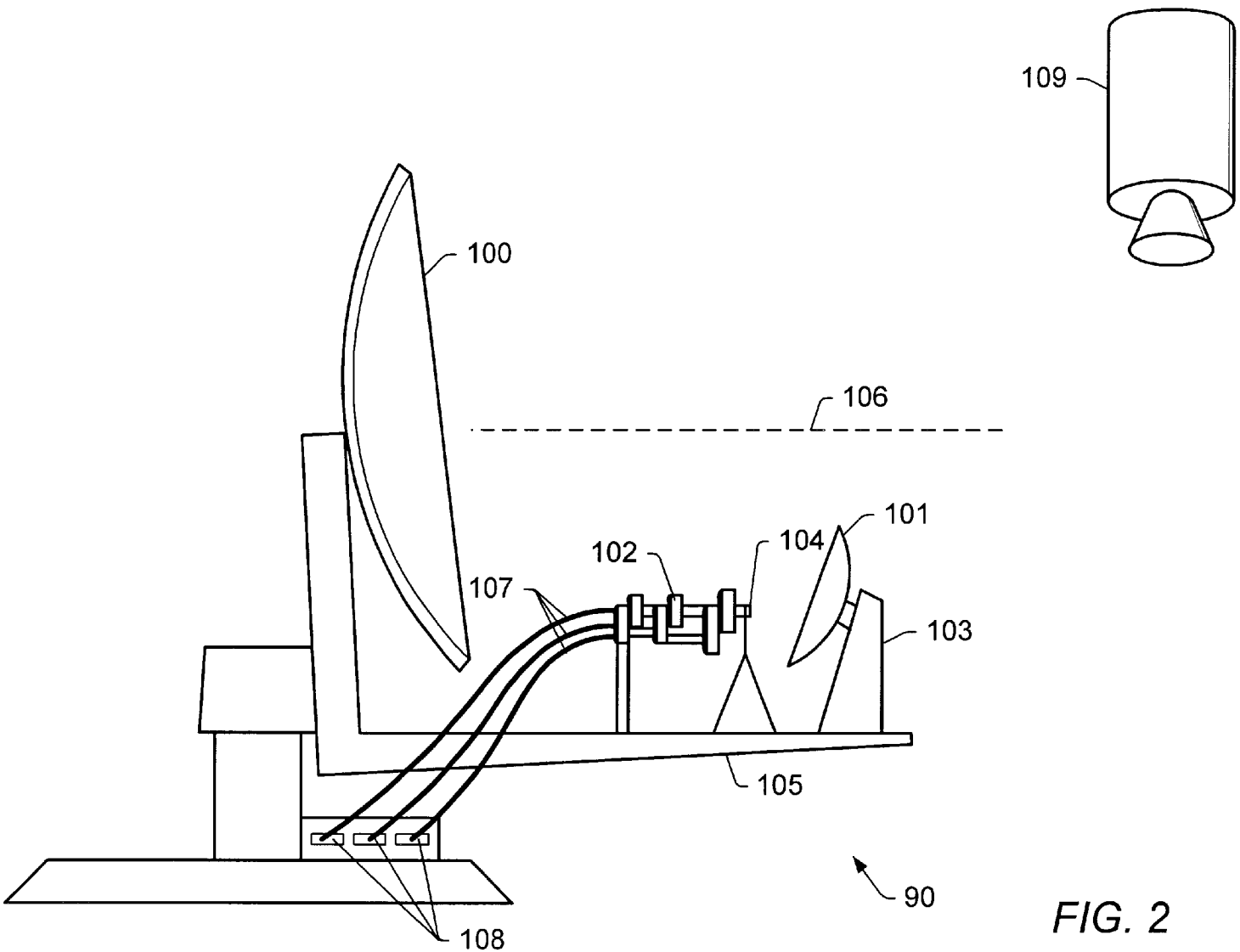
FIG. 2 is a diagram of one embodiment of a satellite antenna system utilizing one embodiment of a multi-band antenna feed.

Turning now to FIG. 2, one embodiment of an antenna system 90 utilizing a multi-band antenna feed 102 is shown. In this embodiment, antenna system 90 includes a main reflector 100, a subreflector 101, and an antenna feed 102. The main reflector 100 is preferably paraboloidal and is, with subreflector 101 and feed 102 in a Gregorian configuration in which subreflector 101 is near a focal point 103 of main reflector 100 and feed 102 is near a focal point 104 of subreflector 101. A support member 105 supports subreflector 101 and feed 102 in positions away from main axis 106 of the main reflector 100. Waveguides 107 connect the feed 102 to a plurality of transceivers 108. While three transceivers 108 are shown, other combinations of transmitters and receivers are possible.

When antenna system 90 is being used to transmit signals to a remote station 109 such as an earth satellite, transceivers 108 send electromagnetic radiation down waveguides 107 to feed 102. The electromagnetic radiation exits feed 102 and travels to subreflector 101. Subreflector 101 reflects the electromagnetic radiation toward main reflector 100. The main reflector reflects the electromagnetic radiation toward the remote station 109.

When the antenna system is being used to receive signals transmitted by a remote station 109, the remote station transmits electromagnetic radiation toward main reflector 100, which reflects the electromagnetic radiation toward its focal point 103 and the nearby subreflector 101. Subreflector 101 in turn reflects the electromagnetic radiation toward feed 102. The electromagnetic radiation propagates through the feed to waveguides 107. Waveguides 107 carry the electromagnetic radiation to the transceivers 108.

Figure 3:
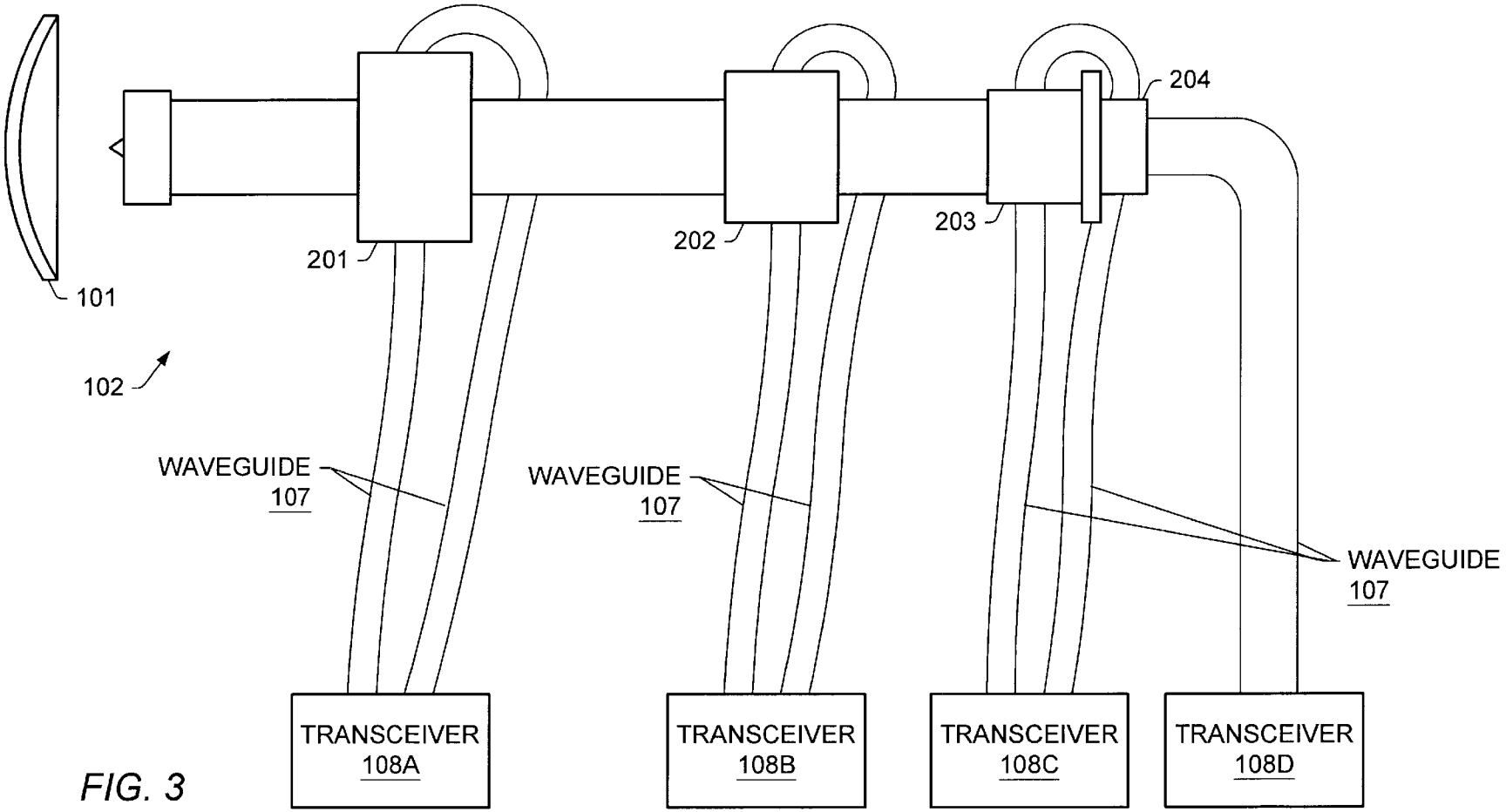
FIG. 3 is a diagram of one embodiment of an antenna feed connected to a set of transceivers by a set of waveguides.

Referring now to FIG. 3, the structure and the relative positions of the antenna feed 102 and the subreflector 101 are shown in more detail. In the following discussion, the end of feed 102 near subreflector 101 is referred to as the "front" end and the opposite end is referred to as the "rear" end. In one embodiment, antenna feed 102 has a junction 201 for the entry and exit of electromagnetic radiation in the lower part of the C frequency band, a junction 202 for the entry and exit of electromagnetic radiation in the upper part of the C band, a junction 203 for the entry and exit of electromagnetic radiation in the X band, and an interface (or flange) 204 for the entry and exit of electromagnetic radiation in the Ku band. As used herein, the term "bands" shall refer to both bands and distinct sub-bands. Waveguides 107 connect junctions 201, 202, and 203 and interface 204 to transceivers 108.

When the antenna system is being used to receive signals (as from remote station 109 in FIG. 1), electromagnetic radiation is reflected from subreflector 101 into the open front end of feed 102. Electromagnetic radiation signals in the lower C band propagate down a part of the length of the feed 102 to junction 201, where they exit the feed 102 and propagate away from the feed 102 through one set of waveguides 107 to one of the transceivers 108. Electromagnetic radiation signals in the upper C band propagate down a part of the length of the feed 102 to junction 202, where they exit the feed 102 and propagate away from the feed 102 through one set of waveguides 107 to one of the transceivers 108. Electromagnetic radiation signals in the X band propagate down a part of the length of the feed 102 to junction 203, where they exit the feed 102 and propagate away from the feed 102 through one set of waveguides 107 to one of the transceivers 108. Electromagnetic radiation signals in the Ku band propagate down the length of the feed 102 to the rear end of the feed 102, where they exit the feed 102 and propagate away from the feed 102 through one set of waveguides 107 to transceivers 108.

When the antenna system is being used to transmit signals (as to remote station 109 in FIG. 1), electromagnetic radiation propagates from transceivers 108 through waveguides 107 to junctions 201, 202, and 203, and to interface 204 to the feed 102. Electromagnetic radiation in the Ku band enters the feed 102 at the rear end of the feed 102. Electromagnetic radiation in the X band enters the feed 102 at junction 203. Electromagnetic radiation in the upper C band enters the feed 102 at junction 202. Electromagnetic radiation in the lower C band enters the feed 102 at junction 201. After entering the feed 102, the electromagnetic radiation in all four bands propagates to the front end of the feed 102. The electromagnetic radiation in all four bands exits the feed 102 at the its front end and propagates to the subreflector 101, where it is reflected to the main antenna 100 of FIG. 1. The electromagnetic radiation is then reflected to the remote station 109 of FIG. 1.

Antenna feed 102 and subreflector 101 enable an antenna system to transmit and receive signals simultaneously. While one embodiment enables transmission and reception of signals in the lower C, upper C, X, and Ku bands simultaneously, other embodiments enable such simultaneous transmission and reception of signals in the L and S bands; in the Ka and Ku bands; and in the lower C, upper C, X, Ku, and Ka bands.

Figure 4:
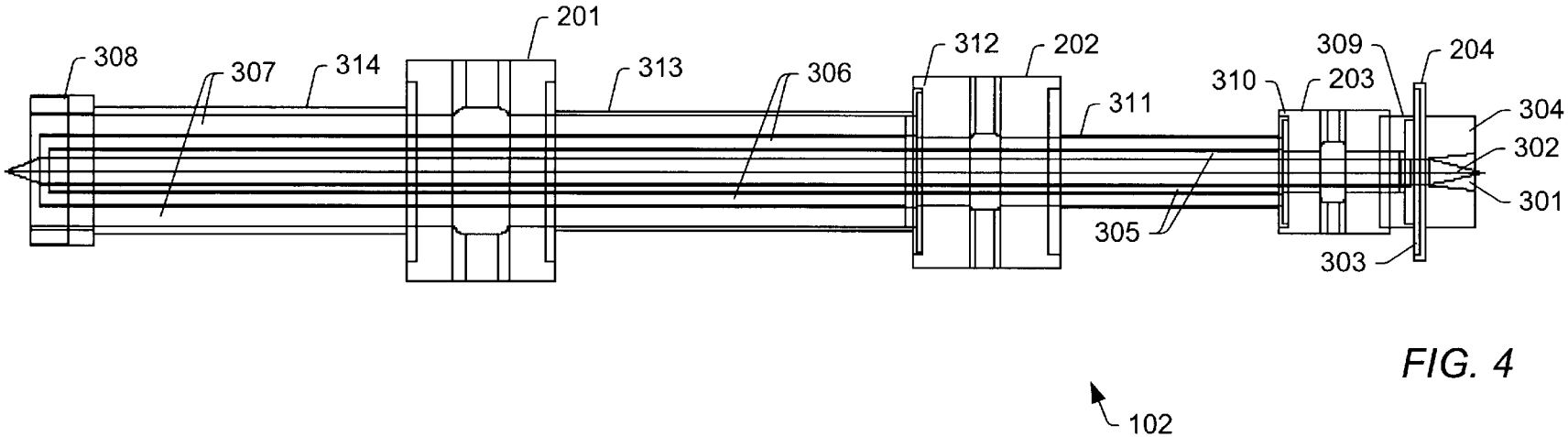
FIG. 4 is a cross-section of one embodiment of a multi-band antenna feed.
Figure 5:
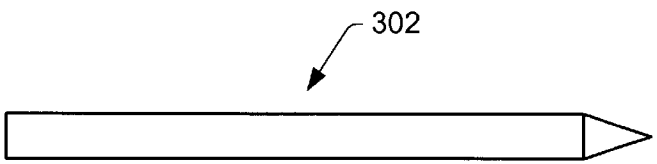
FIG. 5 is a cross-section of one embodiment of a dielectric loading rod.

Referring now to FIG. 4, the internal structure of the antenna feed 102 is shown in more detail. In one embodiment, the components of the feed 102 are made of brass; in another embodiment, they are made of aluminum. In one embodiment, a coaxial cavity 301 for the propagation of electromagnetic radiation in the Ku band runs down the length of the feed 102. In one embodiment, the Ku band cavity 301 is 27.300 in. long and has an inner diameter of 0.500 in., and the waveguide forming the outer surface of the Ku band cavity 301 may have an outer diameter of 0.580 in. The cavity 301 may contain a dielectric loading rod 302, which adjusts the frequency response of the cavity 301 to allow the propagation of electromagnetic radiation in the Ku band. In one embodiment, the rod 302 is made of rexalite, a material with a dielectric constant of approximately 2.3. FIG. 5 shows the rod 302 in more detail. In one embodiment, the rod has a cylindrical part which is 0.500 in. in diameter and 26.000 in. long and a part 1.100 in. long that tapers to a point. In one embodiment, the cutoff frequency for the cavity 301 is lowered to 8.665 GHz by the use of the rod 302.

Figure 6A:
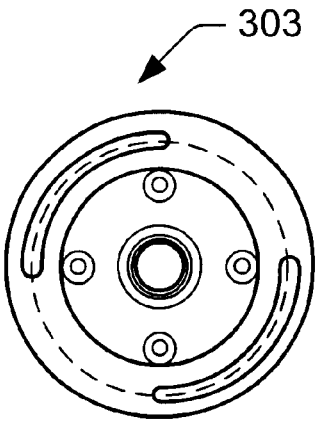
FIGS. 6*a, b* and *c* are diagrams of one embodiment of a flange.
Figure 6B:
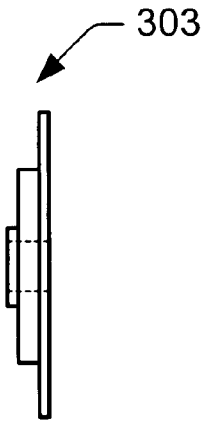
Figure 6C:
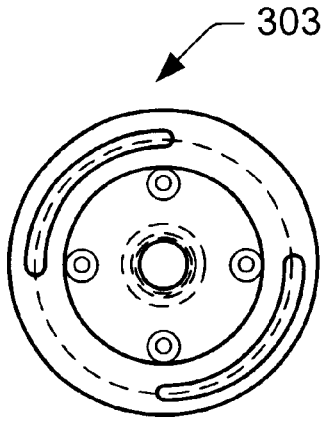

The waveguide forming the outer surface of cavity 301 is soldered into a flange 303 into which radial slots are cut to allow the polarization of the signals in the cavity to be adjusted manually. FIGS. 6*a–c* show the flange in more detail. FIG. 6*a* is a view from the front, FIG. 6*b* is a view from the side, and FIG. 6*c* is a view from the rear. In one embodiment, the front component of the flange 303 is 0.797 in. in diameter, 0.100 in. thick and has a central hole of diameter 0.500 in.; the middle component is 1.900 in. in diameter, 0.100 in. thick, and has a central hole of diameter 0.580 in.; and the rearmost component is 3.000 in. in diameter, 0.100 in. thick, and has a central hole of diameter 0.500 in. In one embodiment, there are two 90° radial slots in the rearmost component that are 0.170 in. wide at a radius of 1.250 in. from the longitudinal axis of the flange.

Figure 7A:
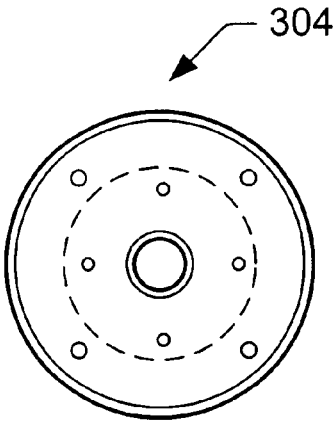
FIGS. 7*a, b* and *c* are diagrams of one embodiment of an interface.
Figure 7B:
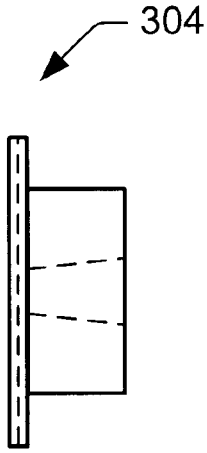
Figure 7C:
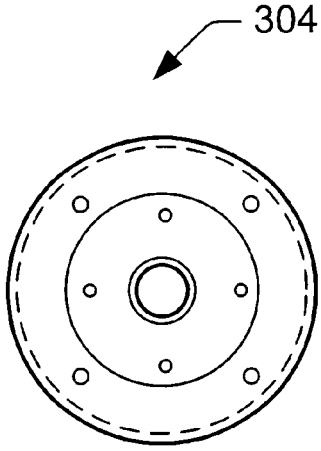

The cavity 301 is also connected to an interface 304 that connects the cavity 301 to a waveguide 107 of FIG. 1 of standard size in the industry. FIGS. 7*a–c* show the interface 304 in more detail. FIG. 7*a* is a view from the front, FIG. 7*b* is a view from the side, and FIG. 7*c* is a view from the rear. In one embodiment, the outer diameter of the disk that forms the front part of the interface 304 is 3.200 in., the inner diameter of the ring at the rim of the disk on the front side is 3.000 in., and the inner diameter of the hole in the center of the front part is 0.500 in. In one embodiment, the thickness of the disk at the front is 0.100 in., and the thickness of the ring is 0.200 in. In one embodiment, the length of the interface 304 from the front edge of the ring at the front to the rear surface is 1.200 in. In one embodiment, the component of the interface 304 which forms the rear part of the interface is 2.000 in. in diameter and the hole through the center of the interface 304 is 0.673 in. in diameter at the rear surface.

Figure 8A:
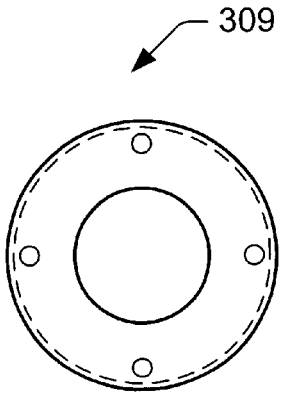
FIGS. 8*a, b* and *c* diagrams of one embodiment of a link.
Figure 8B:
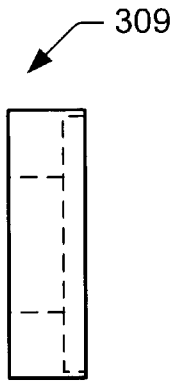
Figure 8C:
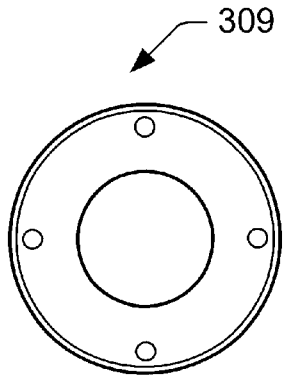

Link 309 connects cavity 301 to cavity 305. The waveguide forming the outer surface of cavity 301 is inserted through the center of link 309 to form this connection. FIGS. 8*a–c* show link 309 in more detail. FIG. 8*a* is a front view, FIG. 8*b* is a side view, and FIG. 8*c* is a rear view. In one embodiment, the front of the link 309 comprises a round cavity of inner diameter 0.797 in. and a front-to-rear depth of 0.500 in., the rear of the link 309 comprises a cavity of inner diameter 1.900 in., and the front-to-rear length of the link 309 is 0.700 in. In one embodiment, the outer diameter of the wall of the cavity is 2.000 in.

Junction 203 is an orthomode transducer through which electromagnetic radiation in the X band enters and exits a coaxial cavity 305. The longitudinal axis of the cavity 305 coincides with the longitudinal axis of cavity 301. The inner conductor of the cavity 305 is formed by the outer conductor of the cavity 301. The cavity 305 runs from the junction 203 to the front end of the feed 102.

In one embodiment, the cavity 305 is configured for the propagation of electromagnetic radiation in the X band. In one embodiment, the X band cavity 305 is 24.880 in. long and has an inner diameter of 0.797 in. In one embodiment, the waveguide forming the outer surface of the X band cavity 305 has an outer diameter of 0.895 in.

Figure 9A:
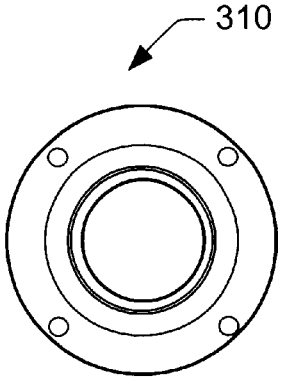
FIGS. 9*a* and *b* diagrams of one embodiment of a flange.
Figure 9B:
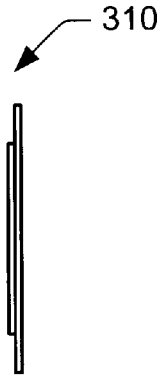

The waveguide forming the outer surface of cavity 305 is soldered into a flange 310. FIGS. 9*a–b* show the flange in more detail. FIG. 9*a* is a view from the front. FIG. 9*b* is a view from the side. In one embodiment, the front component of the flange 310 is 1.245 in. in diameter, 0.100 in. thick, and has a central hole of diameter 0.950 in. at the front, narrowing at a 45° angle to a diameter of 0.900 in.; and the rear component is 1.900 in. in diameter, 0.100 in. thick, and has a central hole of diameter 0.797 in.

Figure 10A:
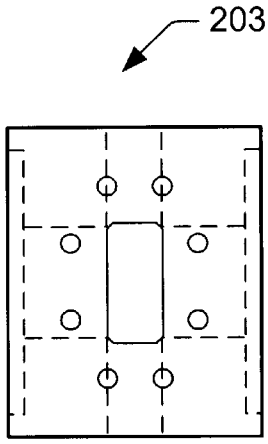
FIGS. 10*a* and *b* diagrams of one embodiment of a junction.
Figure 10B:
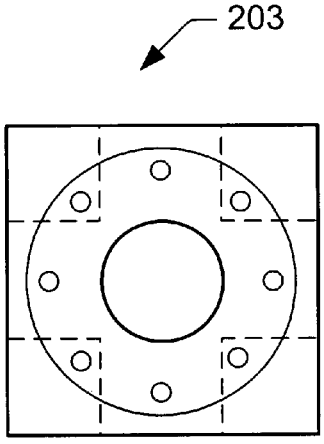

The junction 203 permits the propagation of electromagnetic radiation from the cavity 305 to waveguides 107 of FIG. 2 of rectangular cross-section, and from those waveguides 107 to the cavity 305. FIGS. 10*a–b* show the junction 203 in more detail. FIG. 10*a* is a side view and FIG. 10*b* is a front view. In one embodiment for coupling an X band cavity 305 to the waveguides 107, the distance from the front to the rear of the interior the junction cavities and of each waveguide 107 at the point it joins the junction 203 is 0.497 in., the inner width is 1.122 in., and has rounded comers of 0.125 in. radius. In one embodiment, the hole through the longitudinal axis of the junction 203 has a diameter of 0.797 in. In one embodiment, the junction 203 is 2.200 in. from front to rear and 2.250 in. wide and 2.250 in. high.

Figure 11A:
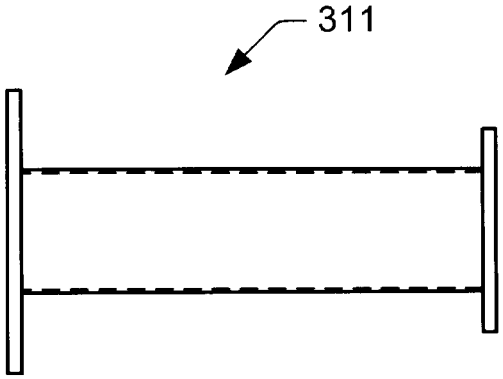
FIGS. 11*a* and *b* are diagrams of one embodiment of a link.
Figure 11B:
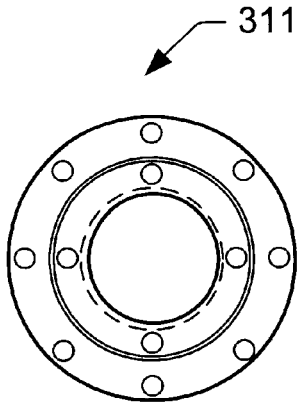

Link 311 connects waveguide forming the outer surface of cavity 305 to the waveguide forming the outer surface of cavity 306. The waveguide forming the outer surface of cavity 305 is inserted through the center of link 311 to form this connection. FIGS. 11*a–b* show link 311 in more detail. FIG. 11*a* is a side view. FIG. 11*b* is a rear view. In one embodiment, the front of the link 311 comprises a round component of diameter 3.000 in. and a thickness of 0.200 in., the rear of the link 311 comprises a component of diameter 2.000 in. and a thickness of 0.200 in., and these two components are joined by a cylindrical component 4.350 in. in length. The front end of the link 311 is connected to junction 202 and the read end of the link 311 is connected to junction 203.

Junction 202 is an orthomode transducer through which electromagnetic radiation in the upper C band enters and exits a coaxial cavity 306. The longitudinal axis of the cavity 306 coincides with the longitudinal axis of cavity 305. The inner conductor of the cavity 306 is formed by the outer conductor of the cavity 305. The cavity 306 runs from the junction 202 to the front end of the feed 102.

In one embodiment, the cavity 306 is configured for the propagation of electromagnetic radiation in the upper C band. In one embodiment, the upper C band cavity 306 is 17.630 in. long and has an inner diameter of 1.281 in. and the waveguide forming the outer surface of the X band cavity 305 has an outer diameter of 1.441 in.

Figure 12A:
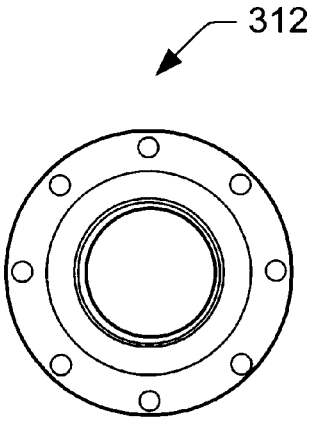
FIGS. 12*a, b* and *c* are diagrams of one embodiment of a flange.
Figure 12B:
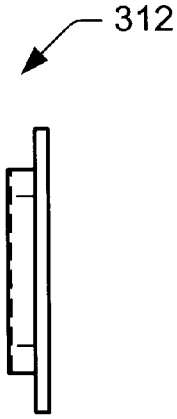
Figure 12C:
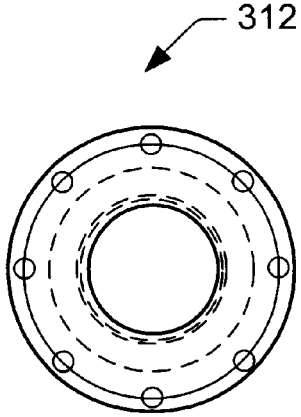

The waveguide which forms the outer surface of cavity 306 is soldered into a flange 312. FIGS. 12*a–c* show the flange in more detail. FIG. 12*a* is a view from the front. FIG. 12*b* is a view from the side. FIG. 12*c* is a view from the rear. In one embodiment, the front component of the flange 312 is 2.029 in. in diameter, 0.250 in. thick, and has a central hole of diameter 1.535 in. at the front, narrowing at a 45° angle to a diameter of 1.450 in.; and the rear component is 2.900 in. in diameter, 0.220 in. thick., and has a central hole of diameter 1.291 in.

Figure 13A:
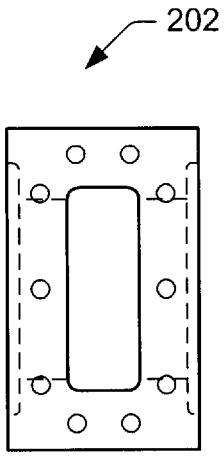
FIGS. 13*a* and *b* are diagrams of one embodiment of a junction.
Figure 13B:
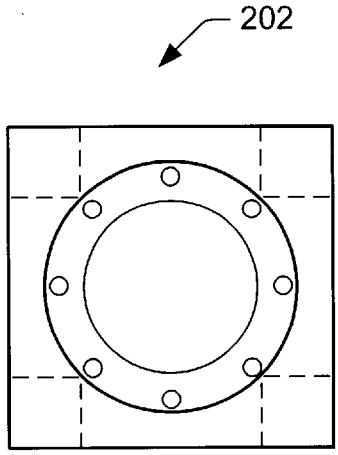

The junction 202 permits the propagation of electromagnetic radiation from the cavity 306 to waveguides 107 of FIG. 2 of rectangular cross-section, and from those waveguides 107 to the cavity 306. FIGS. 13*a–b* show the junction 202 in more detail. FIG. 13*a* is a side view and FIG. 13*b* is a front view. In one embodiment for coupling an upper C band cavity 306 to the waveguides 107, the distance from the front to the rear of the interior the junction cavities and of each waveguide 107 at the point it joins the junction 202 is 0.622 in., the inner width is 1.372 in., and has rounded comers of 0.250 in. radius. In one embodiment, the hole through the longitudinal axis of the junction 202 has a diameter of 1.281 in. In one embodiment, the junction 202 is 2.900 in. from front to rear, 3.470 in. wide, and 3.470 in. high.

Figure 14A:
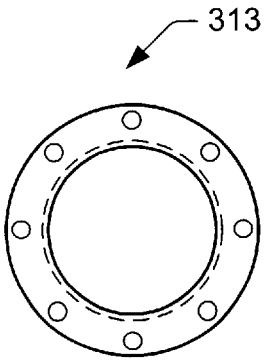
FIGS. 14*a, b* and *c* are diagrams of one embodiment of a link.
Figure 14B:
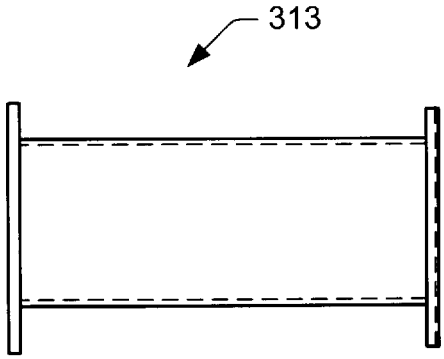
Figure 14C:
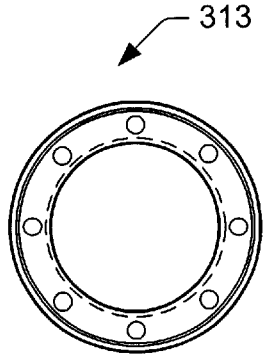

Link 313 connects waveguide forming the outer surface of cavity 306 to the waveguide forming the outer surface of cavity 307. The waveguide forming the outer surface of cavity 306 is inserted through the center of link 313 to form this connection. FIGS. 14*a–c* show link 313 in more detail. FIG. 14*a* is a front view. FIG. 14*b* is a side view. FIG. 14*c* is a rear view. In one embodiment, the front of the link 313 comprises a round component of diameter 3.250 in. and a thickness of 0.200 in., the rear of the link 313 comprises a component of diameter 3.000 in. and a thickness of 0.200 in., and these two components are joined by a cylindrical component 7.075 in. in length. The front end of the link 313 is connected to junction 201 and the read end of the link 313 is connected to junction 202.

Junction 201 is an orthomode transducer through which electromagnetic radiation in the lower C band enters and exits a coaxial cavity 307. The longitudinal axis of the cavity 307 coincides with the longitudinal axis of cavity 306. The inner conductor of the cavity 307 is formed by the outer conductor of the cavity 306. The cavity 307 runs from the junction 201 to the front end of the feed 102. The junction 201 permits the propagation of electromagnetic radiation from the cavity 307 to waveguides 107 of rectangular cross-section, and from those waveguides 107 to the cavity 307.

Figure 21A:
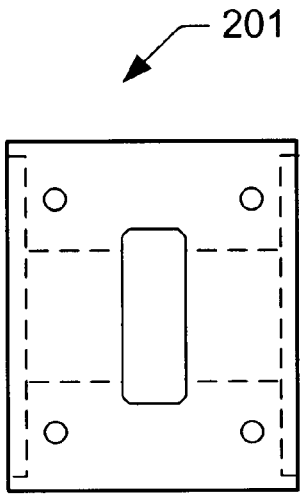
FIGS. 21*a* and *b* are diagrams of one embodiment of a junction.
Figure 21B:
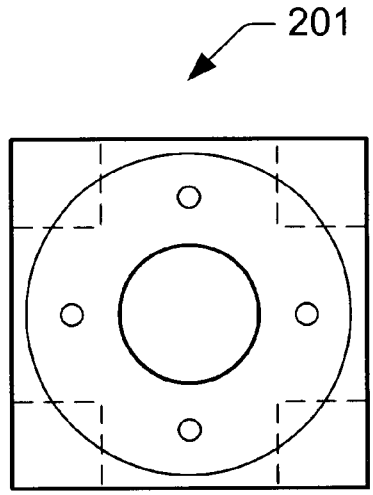

The junction 201 permits the propagation of electromagnetic radiation from the cavity 307 to waveguides 107 of FIG. 2 of rectangular cross-section, and from those waveguides 107 to the cavity 307. FIG. 21 show the junction 201 in more detail. FIG. 21*a* is a front view and FIG. 21*b* is a side view. In one embodiment for coupling a lower band cavity 307 to the waveguides 107, the distance from the front to the rear of the junction cavities and of each waveguide 107 at the point it joins the junction is 1.145 in., the inner width is 2.290 in., and has rounded corners of 0.250 in. radius. In one embodiment, the hole through the longitudinal axis of the junction 201 has a diameter of 2.029 in. In one embodiment, the junction 202 is 2.950 in. from front to rear, 4.000 in. wide and 4.000 in. high.

Figure 15A:
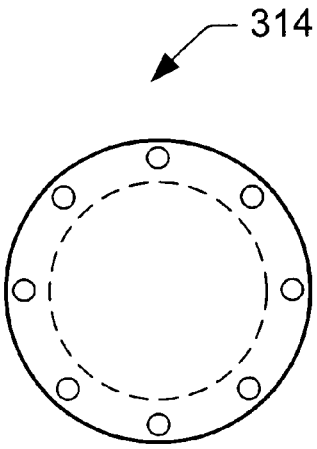
FIGS. 15*a* and *b* are diagrams of one embodiment of a waveguide.
Figure 15B:
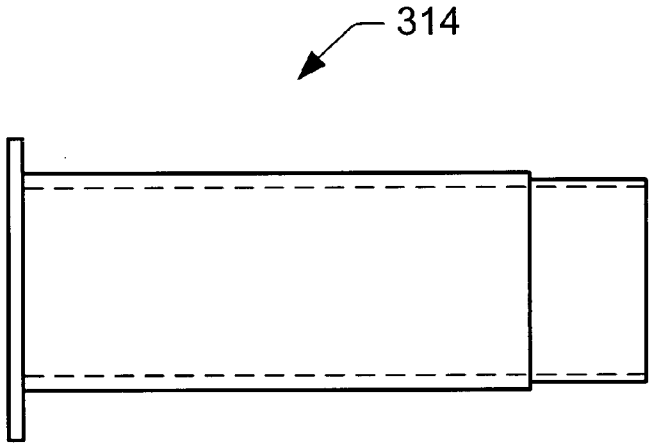

Waveguide 314 forms the outer surface of cavity 307. FIGS. 15*a–b* show the waveguide 314 in more detail. FIG. 15*a* is a rear view. FIG. 15*b* is a side view. In one embodiment, the circular component at the rear of the waveguide 314 has a diameter of 3.250 in. and a thickness of 0.200 in. In one embodiment, the cavity surface is formed by a cylindrical component with a length of 7.505 in., an inner diameter 2.029 in., and an outer diameter of 2.129 in. for all but the front 2.300 in. of its length, where it has an outer diameter of 2.129 in.

Figure 16A:
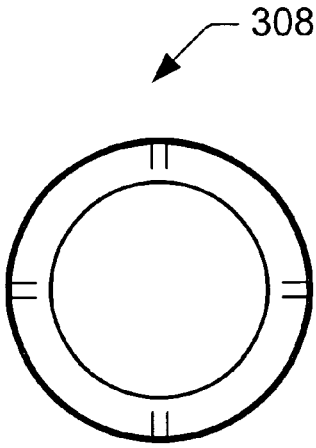
FIGS. 16*a* and *b* are diagrams of one embodiment of a choke.
Figure 16B:
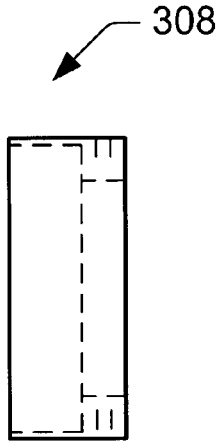

In one embodiment, choke 308 is attached to the front end of the waveguide forming the outer surface of cavity 307. Choke 308 narrows the radiation pattern of the cavity 307 by preventing spillover around the edges at the front end of the cavity. FIGS. 16*a–b* show the choke 308 in more detail. FIG. 16*a* is a front view. FIG. 16*b* is a side view. In one embodiment, the front of the choke 308 comprises a round cavity of inner diameter 2.629 in and a front-to-rear depth of 0.750 in., the rear of the choke 308 comprises a cavity of inner diameter 2.129 in., and the front-to-rear length of the choke 308 is 1.250 in. In one embodiment, the outer diameter of the wall of the cavity is 2.729 in.

One embodiment uses a "double slug" approach to change the characteristic impedance of the cavity 307. In the double slug approach, two annular rings of metal or dielectric are placed between the inner and outer conductors forming the cavity 307. Different placements of the rings result in different characteristic impedances.

Figure 17:
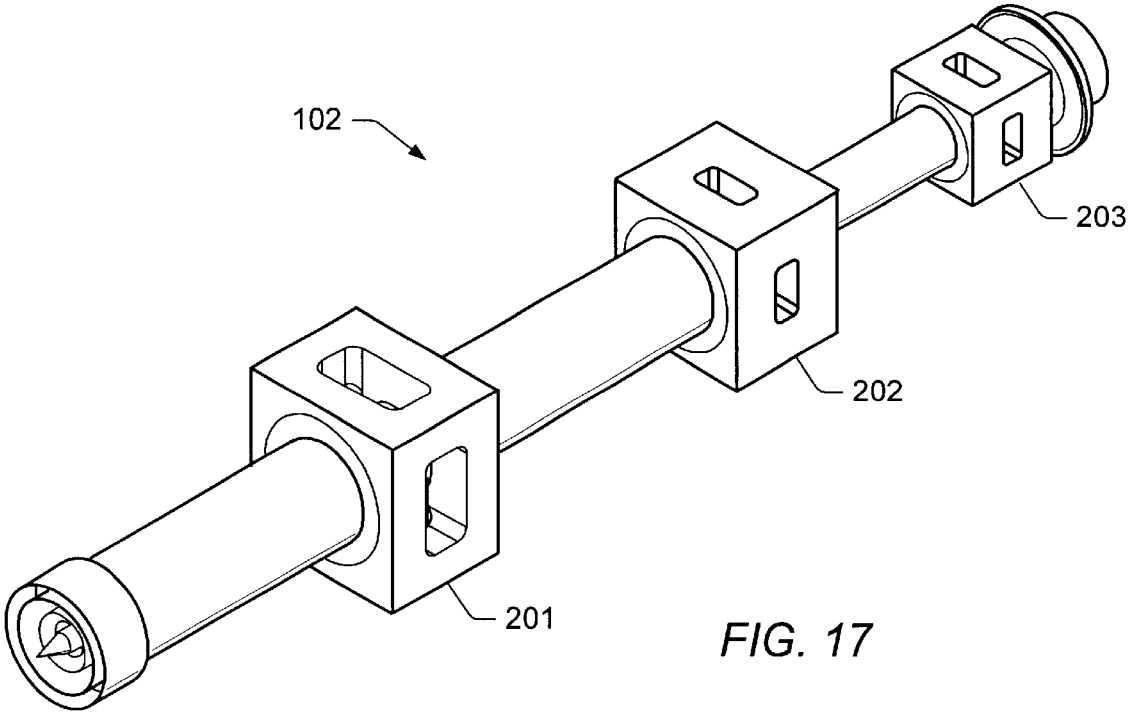
FIG. 17 is an isometric view of one embodiment of an antenna feed.

Turning now to FIG. 17 an isometric view of feed 102 is shown. As the FIG. illustrates, in one embodiment junctions 201–203 comprise four ports equally spaced (e.g., by 90 degrees). Each port is configured to be coupled to an external waveguide 107 (in this case, rectangular) that will convey the received waves to transceivers 108 (or vice versa). Each port conveys a different phase of the waves. In one embodiment, the rectangular waveguides 107 pass the waves through a receiving circuit before they arrive at the transceivers 108.

Figure 18:
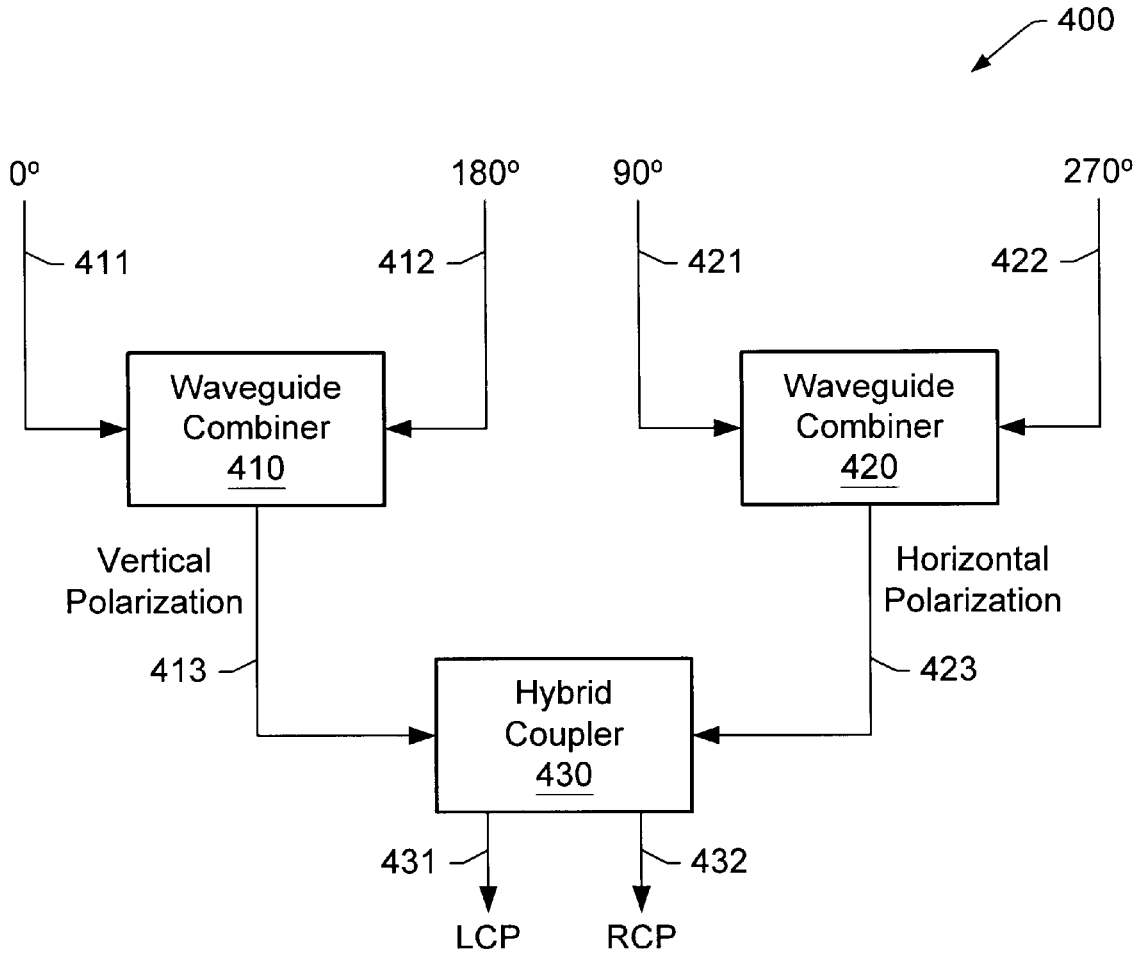
FIG. 18 is a diagram of a circuit for receiving and transmitting circularly polarized signals.

Turning now to FIG. 18, one embodiment of a polarization circuit 400 for circularly polarized radiation signals is shown. Circuit 400 includes a waveguide combiner 410 with inputs 411 and 412, a second waveguide combiner 420 with inputs 421 and 422, and a hybrid coupler 430 coupled to waveguide combiners 410 and 420.

When the antenna system is receiving signals, electromagnetic radiation from each of the orthomode junctions 201, 202, and 203 propagates from the feed 102 through waveguides 107 to corresponding circuits 400. Waveguides 107 convey electromagnetic radiation to the corresponding circuits 400 from coupling ports on the orthomode junctions 201, 202, and 203.

Each of the orthomode junctions preferably includes four coupling ports. The four coupling ports are arranged in a square geometry to couple to linearly polarized electromagnetic radiation in the corresponding cavities (307, 306, 305). The four ports comprise two pairs of opposing ports; one of the pairs couples to radiation linearly-polarized in a particular direction—a "vertical" direction, while the other pair of opposing ports couples to radiation linearly-polarized in an orthogonal direction—a "horizontal" direction. Four waveguides 107 convey electromagnetic radiation from an orthomode junction (one of 201, 202, and 203) to a circuit 400.

Each of the four waveguides is coupled to one of the four coupling ports and to one of four inputs 411, 412, 421, and 422 on circuit 400. The four wave guides, included in the waveguides 107, are configured to convey radiation from one of the pairs of opposing ports to inputs 411 and 412, and to convey radiation from the other of the pairs 10 of opposing ports to inputs 421 and 422. To constructively add the four radiation signals received through the four waveguides, waveguide combiner 410 subtracts the signal from input 412 (which is shifted by 180° in phase) from the signal from input 411 to generate a combined signal 413. Similarly, waveguide combiner 420 subtracts the signal from input 422 (which is shifted by 270° in phase) from the signal from input 421 (which is shifted by 90° in phase), to generate a combined signal 423. Hybrid coupler 430 receives the two combined signals 413 and 423 further combines them to generate an LCP 431 output signal. Hybrid coupler 430 also combines the two combined signals in an orthogonal manner to generate a RCP output signal 432.

If the radiation received by circuit 400 was left-hand circularly polarized (LCP) in the corresponding cavity of feed 102, then circuit 400 operates to constructively add the signals received at the four inputs 411, 412, 421, and 422 so that the output appears in LCP output signal 431. Conversely, if the radiation received by circuit 400 was right-hand circularly polarized (RCP) in the corresponding cavity of feed 102, then circuit 400 operates to constructively add the four received signals so that the output appears in RCP output signal 432.

When the antenna system is transmitting signals, the procedure is reversed. A transmission signal applied at port 431 is converted to an LCP wave in the corresponding waveguide, and a transmission signal applied at port 432 is converted to an RCP wave in the corresponding waveguide. In more detail, circuit 400 operates to separate LCP and RCP signals into linearly polarized signals for propagation through the waveguides 107, where they are added together at the corresponding junction (one of 201, 202, and 203) so that LCP and RCP signals propagate through the associated cavity (one of 307, 306, and 305) and out the front end of feed 102.

LCP input signals 431 and RCP input signals 432 are separated by hybrid coupler 430 into signals 413 and 423. Signal 413 represents the vertically polarized components of signal 431 and 432, and signal 423 represents the horizontally polarized components of signals 431 and 432. Combiner 410 separates the signal 413 into two signals, 411 and 412, where signal 412 is shifted by 180° in phase from signal 411. Combiner 420 separates the signal 423 into two signals 421 and 422, where signal 421 is shifted by 90° in phase from signal 411, and signal 422 is shifted by 270° in phase from signal 411. Signals 411, 412, 421, and 422 propagate along waveguides 107 to the coupling ports included in the orthomode junction 201–203, where they are added together in the orthomode junction 201–203 to form the original LCP or RCP signals 431 and 432.

In one embodiment, to receive or transmit a linear polarization, hybrid coupler 430 is manually switched out of the circuit.

Figure 19C:
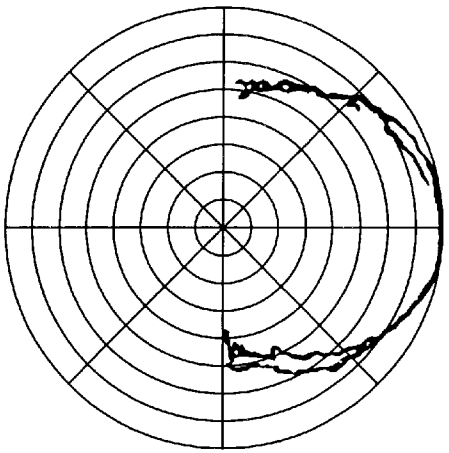
FIGS. 19*a, b* and *c* are sets of plots of radiation patterns generated by one embodiment of an antenna feed.
Figure 19B:
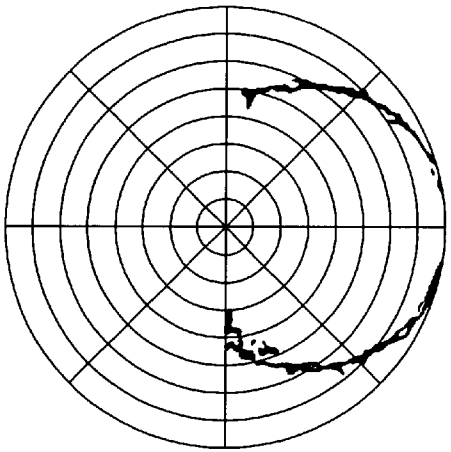
Figure 19A:
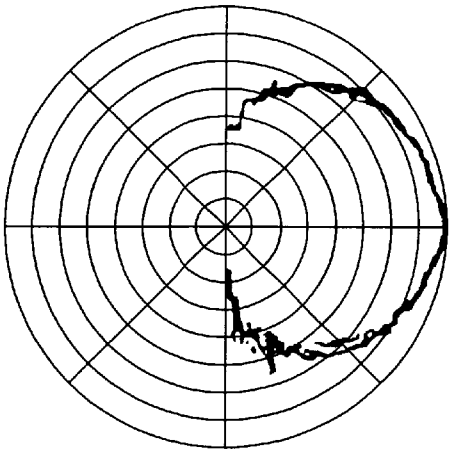

Referring now to FIGS. 19*a–c,* selected radiation patterns created by one embodiment of the feed 102 are shown. FIG. 19*a* shows the primary radiated power pattern at 10.950 GHz. FIG. 19*b* shows the primary radiated power pattern at 7.250 GHz. FIG. 19*c* shows the primary radiated power pattern at 3.625 GHz. These wide patterns may influence the design of the subreflector 101.

Referring now to back to FIG. 2, the design of the subreflector 101 will be discussed in more detail. In the embodiment shown, the subreflector 101 is designed for use in dual-offset Gregorian geometry in which both the antenna feed 102 and subreflector 101 are placed on support element 105 away from the axis 106 of the main reflector 100. This arrangement prevents blockage of the aperture of the main reflector 100 by the feed 102 and the subreflector 101. This arrangement may also allow the transceivers 108 to be placed below and behind the main reflector 100, where they can be connected to the feed 102 with relatively short lengths of waveguide 107. The main reflector 100 is an offset section of a paraboloid with circular aperture of radius 2.4 meters, and defined by the focal length f and height of the midpoint $y_c$. With the origin located at the focus the paraboloidal surface is defined in x, y, z coordinates as:

$$x^2+y^2=4f(f-z) \tag{1}$$

The offset subreflector 101 is an ellipsoid defined by an eccentricity e and the interfocal distance 2c. In dual reflector antenna systems, one focus of the subreflector 101 ellipse is located confocal with the focus of the main reflector 100 parabola. The subreflector 101 axis is tilted by an angle β with respect to the z-axis of the paraboloid.

$$y_c = \frac{-4fe\sin\beta}{1+e^2-2e\cos\beta} \tag{2}$$

$\theta_H$ is the cone angle from focus F1 that defines the rays that illuminate the edge of the subreflector 101, which reflects them on to the edge of the main reflector 100. The angle $\theta_H$ is computed from $$\tan\left(\frac{\theta_H}{2}\right) = \frac{R(1+e^2-2e\cos\beta)}{2f(1-e^2)} \tag{3}$$

Since $\theta_H$ is defined by the primary pattern of the coaxial feed 102, equations 2 and 3 were solved simultaneously to obtain angle β and eccentricity e.

The coaxial feed 102 is located so that its phase center is located at focus F1 and is tilted by an angle α to the subreflector 101 axis so the feed 102 axis points toward the midpoint of the subreflector 101. The angle α is found by $$\tan\alpha = \frac{(1-e^2)\sin\beta}{(1+e^2)\cos\beta-2e} \tag{4}$$

The subreflector 101 surface may be written in x, y, z coordinates about F0 as $$x^2+y^2+Z^2=e^2(z\cos\beta-y\sin\beta+d)^2 \tag{5}$$

where $$d = c\frac{1-e^2}{2e^2} \tag{6}$$

Figure 20:
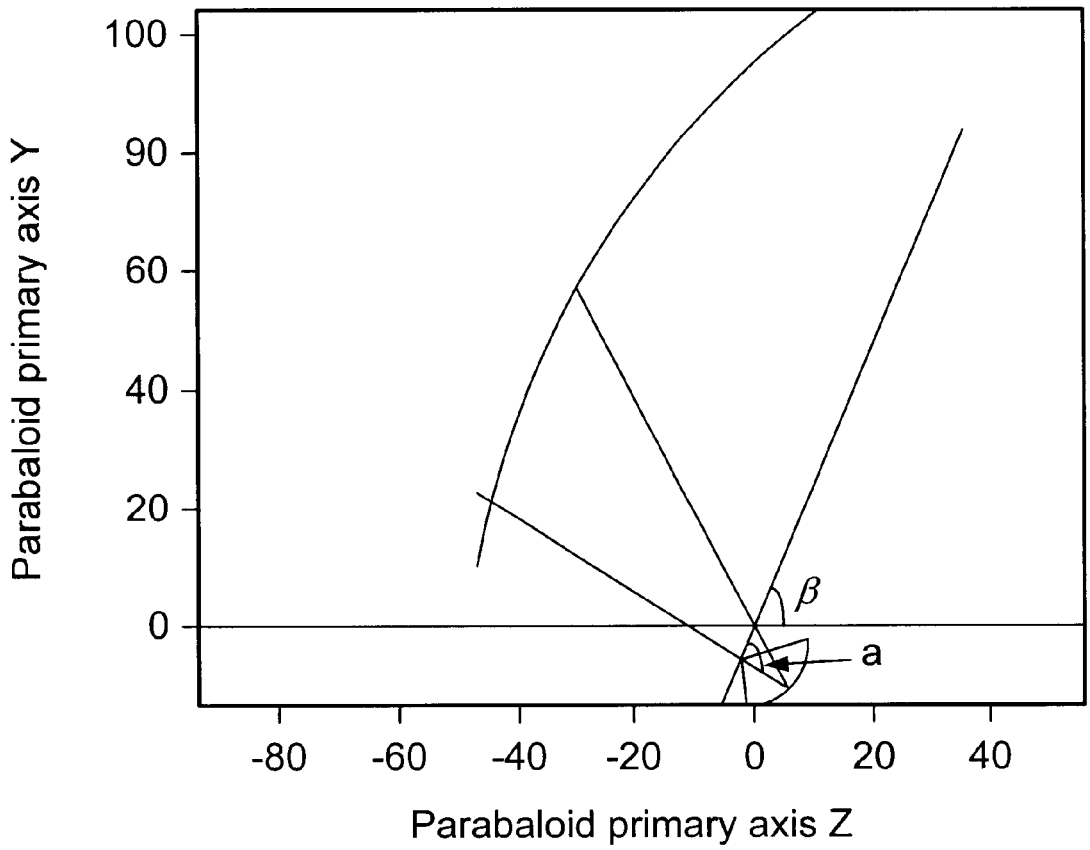
FIG. 20 is a diagram of one embodiment of a dual offset geometry configuration.

Due to the wide-angle nature of the coaxial feed 102, the tilt angles for the subreflector 101 and feed 102 may be relatively large. This may cause some problems when trying to calculate the secondary patterns of this geometry. FIG. 20 shows one embodiment of the dual offset geometry configuration.

Table 1 shows the values that are considered useful for one embodiment of feed 102.

TABLE 1

| Antenna System Parameters | |
|---|---|
| Circular Aperture Size | 2.4 meters |
| Parabolic Reflector Height | 110.4778 inches |
| Focal Length (f) | 47.245 inches |
| Parabola Offset from Vertex of Parent Parabola ($y_c$) | 57.245 inches |
| Angle Beta (β) | 66.9026 degrees |
| Angle Alpha (α) | 99.496 degrees |
| Eccentricity (e) | 0.2826 |
| Interfocal Distance (2c) | 6 inches |
| Subreflector Diameter | 15.4103 inches |
| Feed Arm Length | 61.9574 inches |

The nature of the feed 102 design lends itself to being expandable to more frequency ranges both up and down in frequency. The Ka band is becoming more popular in many systems. The feed design may allow a straightforward expansion into Ka-Band should the requirement arise for a Ka, Ku, X, and C band antenna system. The addition of the Ka band may involve the addition of a circular waveguide to the center of the K band waveguide. This extension would then make the Ku band portion a coaxial waveguide section and may be handled similarly to the C and X band sections. At Ka band frequencies, however, the surface tolerance of the antenna may become more critical, and with the size of the reflector needed for C band the surface tolerance needed for Ka band may be more difficult to achieve.

This technique for the design of a multi-band feed could also be used to design a Ku band and Ka band dual-band feed which may be more practical than a quad-band feed in some implementations. By going to a high frequency dual band feed, the size of the reflector may possibly be reduced. The technique could be used to go down in frequency and produce an L and S band feed. Because of the modularity of the feed, any combination and number of different frequency bands up and down the spectrum might be used.

Although the embodiments above have been described in considerable detail, other versions are possible. Numerous variations and modifications will become apparent to those skilled in the art once the above disclosure is fully appreciated. It is intended that the following claims be interpreted to embrace all such variations and modifications.

What is claimed is:

1. An antenna feed system, comprising:

a first waveguide which coaxially lies along a central axis and a first junction coaxially coupled to the first waveguide;

a second waveguide which coaxially lies along the central axis and a second junction coaxially coupled to the second waveguide;

a third waveguide which coaxially lies along the central axis and a third junction coaxially coupled to the third waveguide;

wherein the first, second, and third waveguides a re each configured to independently transmit, during a first time period, electromagnetic radiation in a particular frequency band simultaneously;

wherein the first, second, and third junctions are disposed to propagate electromagnetic radiation into and out of the respective first, second, and third waveguides;

wherein each junction comprises four equally spaced coupling ports, wherein each of the coupling ports is configured to propagate a different phase of electromagnetic radiation into and out of the respective waveguide;

wherein the junctions are sequentially arranged along the central axis and wherein each junction resides at a terminal end of each respective waveguide; and wherein each of the junctions is independently coupled to a plurality of external rectangular waveguides, and wherein each of the external rectangular waveguides are disposed to propagate electromagnetic radiation to and from the respective junction.

2. The system recited in claim 1, wherein:

the first waveguide is formed from first and second cylindrical conductors, wherein a diameter of the second cylindrical conductor is greater than a diameter of the first cylindrical conductor;

the second waveguide is formed from the second cylindrical conductor and a third cylindrical conductor, wherein a diameter of the third cylindrical conductor is greater than the diameter of the second cylindrical conductor; and the third waveguide is formed from the third cylindrical conductor and a fourth cylindrical conductor, wherein a diameter of the fourth cylindrical conductor is greater than the diameter of the third cylindrical conductor.

3. The system recited in claim 2, further comprising a fourth waveguide which coaxially lies along the central axis, wherein the fourth waveguide is formed from the first cylindrical conductor, and wherein the fourth waveguide is configured to independently transmit, during the first time period, electromagnetic radiation in a particular frequency band simultaneously.

4. The system recited in claim 2, further comprising a dielectric loading rod positioned coaxially within said first cylindrical conductor.

5. The system recited in claim 3, further comprising a fifth waveguide positioned coaxially within the first cylindrical conductor, wherein the fifth waveguide is configured to independently transmit, during the first time period, electromagnetic radiation in a particular frequency band simultaneously.

6. The system recited in claim 5, wherein the first waveguide is configured to propagate electromagnetic radiation in the X-band frequency range, wherein the second waveguide is configured to propagate electromagnetic radiation in the upper C-band frequency range, wherein the third waveguide is configured to propagate electromagnetic radiation in the lower C-band frequency range, wherein the fourth waveguide is configured to propagate electromagnetic radiation in the Ku-band frequency range, and wherein the fifth waveguide is configured to propagate electromagnetic radiation in the Ka-band frequency range.

7. The system recited in claim 1, wherein each of the particular frequency bands is selected from the group of frequency bands consisting of: the L-band, the S-band, the lower C-band, the upper C-band, the X-band, the Ku-band, and the Ka-band.

8. The system recited in claim 1, wherein each of the junctions are further coupled, through the respective plurality of rectangular waveguides, to a separate polarization circuit.

9. The system recited in claim 8, wherein each polarization circuit comprises:

a first waveguide combiner coupled to the rectangular waveguides, wherein the first waveguide combiner is configured to receive a first input and a second input, wherein the first and second inputs comprise a vertical signal component of an electromagnetic wave received by the antenna system, wherein the first waveguide combiner subtracts the first input from the second input to form a first combined signal;

a second waveguide combiner coupled to the rectangular waveguides, wherein the second waveguide combiner is configured to receive a third input and a fourth input, wherein the third and fourth inputs comprise a horizontal signal component of the electromagnetic wave received by the antenna feed system, wherein the second waveguide combiner subtracts the fourth input from the third input to generate a second combined signal; and a hybrid coupler configured to receive and combine the first and second combined signals to generate an output signal therefrom.

10. The system recited in claim 8, wherein each polarization circuit comprises:

a hybrid coupler configured to receive a transmit signal, and to generate vertical and horizontal signal components therefrom;

a first waveguide combiner coupled to the hybrid coupler, wherein the first waveguide combiner is configured to receive the vertical signal component and generate a first output signal and a second output signal in response to the vertical signal component, wherein the second output signal is 180 degrees out-of-phase with the first output signal; and a second waveguide combiner coupled to the hybrid coupler, wherein the second waveguide combiner is configured to receive the horizontal signal component and generate a third and a fourth output signal in response to the horizontal signal component, wherein the third output is 90 degrees out-of-phase with the first output signal, and wherein the fourth output signal is 270 degrees out-of-phase with the first output signal, wherein the first and second waveguide combiners are configured to convey the first, second, third, and fourth output signals to the corresponding junction, wherein the corresponding junction is configured to create a circularly polarized electromagnetic wave from the first, second, third, and fourth output signals.

11. The system recited in claim 1, wherein during a second time period the first, second, and third waveguides are configured to respectively transmit, receive, and transmit electromagnetic radiation in a particular frequency band simultaneously.

12. An antenna feed system, comprising:

a first waveguide which coaxially lies along a central axis and a first junction coaxially coupled to the first waveguide;

a second waveguide which coaxially lies along the central axis and a second junction coaxially coupled to the second waveguide;

a third waveguide which coaxially lies along the central axis and a third junction coaxially coupled to the third waveguide;

wherein the first, second, and third waveguides are each configured to independently receive, during a first time period, electromagnetic radiation in a particular frequency band simultaneously;

wherein the first, second, and third junctions are disposed to propagate electromagnetic radiation into and out of the respective first, second, and third waveguides;

wherein each junction comprises four equally spaced coupling ports, wherein each of the coupling ports is configured to propagate a different phase of electromagnetic radiation into and out of the respective waveguide;

wherein the junctions are sequentially arranged along the central axis and wherein each junction resides at a terminal end of each respective waveguide; and wherein each of the junctions is independently coupled to a plurality of external rectangular waveguides, and wherein each of the external rectangular waveguides are disposed to propagate electromagnetic radiation to and from the respective junction.

13. The system recited in claim 12, wherein:

the first waveguide is formed from first and second cylindrical conductors, wherein a diameter of the second cylindrical conductor is greater than a diameter of the first cylindrical conductor;

the second waveguide is formed from the second cylindrical conductor and a third cylindrical conductor, wherein a diameter of the third cylindrical conductor is greater than the diameter of the second cylindrical conductor; and the third waveguide is formed from the third cylindrical conductor and a fourth cylindrical conductor, wherein a diameter of the fourth cylindrical conductor is greater than the diameter of the third cylindrical conductor.

14. The system recited in claim 13, further comprising a fourth waveguide which coaxially lies along the central axis, wherein the fourth waveguide is formed from the first cylindrical conductor, and wherein the fourth waveguide is configured to independently receive, during the first time period, electromagnetic radiation in a particular frequency band simultaneously.

15. The system recited in claim 14, further comprising a dielectric loading rod positioned coaxially within said first cylindrical conductor.

16. The system recited in claim 14, further comprising a fifth waveguide positioned coaxially within the first cylindrical conductor, wherein the fifth waveguide is configured to independently receive, during the first time period, electromagnetic radiation in a particular frequency band simultaneously.

17. The system recited in claim 16, wherein the first waveguide is configured to propagate electromagnetic radiation in the X-band frequency range, wherein the second waveguide is configured to propagate electromagnetic radiation in the upper C-band frequency range, wherein the third waveguide is configured to propagate electromagnetic radiation in the lower C-band frequency range, wherein the fourth waveguide is configured to propagate electromagnetic radiation in the Ku-band frequency range, and wherein the fifth waveguide is configured to propagate electromagnetic radiation in the Ka-band frequency range.

18. The system recited in claim 12, wherein each of the particular frequency bands is selected from the group of frequency bands consisting of: the L-band, the S-band, the lower C-band, the upper C-band, the X-band, the Ku-band, and the Ka-band.

19. The system recited in claim 12, wherein each of the junctions are further coupled, through the respective plurality of rectangular waveguides, to a separate polarization circuit.

20. The system recited in claim 19, wherein each polarization circuit comprises:

a first waveguide combiner coupled to the rectangular waveguides, wherein the first waveguide combiner is configured to receive a first input and a second input, wherein the first and second inputs comprise a vertical signal component of an electromagnetic wave received by the antenna system, wherein the first waveguide combiner subtracts the first input from the second input to form a first combined signal;

a second waveguide combiner coupled to the rectangular waveguides, wherein the second waveguide combiner is configured to receive a third input and a fourth input, wherein the third and fourth inputs comprise a horizontal signal component of the electromagnetic wave received by the antenna feed system, wherein the second waveguide combiner subtracts the fourth input from the third input to generate a second combined signal; and a hybrid coupler configured to receive and combine the first and second combined signals to generate an output signal therefrom.

21. The system recited in claim 19, wherein each polarization circuit comprises:

a hybrid coupler configured to receive a transmit signal, and to generate vertical and horizontal signal components therefrom;

a first waveguide combiner coupled to the hybrid coupler, wherein the first waveguide combiner is configured to receive the vertical signal component and generate a first output signal and a second output signal in response to the vertical signal component, wherein the second output signal is 180 degrees out-of-phase with the first output signal; and a second waveguide combiner coupled to the hybrid coupler, wherein the second waveguide combiner is configured to receive the horizontal signal component and generate a third and a fourth output signal in response to the horizontal signal component, wherein the third output is 90 degrees out-of-phase with the first output signal, and wherein the fourth output signal is 270 degrees out-of-phase with the first output signal, wherein the first and second waveguide combiners are configured to convey the first, second, third, and fourth output signals to the corresponding junction, wherein the corresponding junction is configured to create a circularly polarized electromagnetic wave from the first, second, third, and fourth output signals.

22. The system recited in claim 12, wherein during a second time period the first, second, and third waveguides are configured to respectively transmit, receive, and transmit electromagnetic radiation in a particular frequency band simultaneously.

23. A method for propagating electromagnetic radiation, the method comprising:

propagating electromagnetic radiation along the length of an antenna feed, wherein the antenna feed comprises a plurality of concentric cylindrical waveguides coaxially arranged and having decreasingly smaller diameters and increasing lengths;

transmitting a first frequency band with the first cylindrical waveguide;

simultaneously transmitting a second frequency band with the second cylindrical waveguide;

simultaneously transmitting a third frequency band with the third cylindrical waveguide;

wherein said transmitting the first, second, and third frequency bands comprises:

propagating electromagnetic radiation corresponding to the first frequency band through a first junction coupled to a terminal end of the first cylindrical waveguide;

propagating electromagnetic radiation corresponding to the second frequency band through a second junction coupled to a terminal end of the second cylindrical waveguide; and propagating electromagnetic radiation corresponding to the third frequency band through a third junction coupled to a terminal end of the third cylindrical waveguide.

24. The method recited in claim 23, wherein said propagating the first, second, and third frequency bands comprises:

propagating electromagnetic radiation corresponding to the first frequency band to the first junction through a first plurality of rectangular waveguides coupled to a first plurality of coupling ports equally spaced around the first junction;

propagating electromagnetic radiation corresponding to the second frequency band to the second junction through a second plurality of rectangular waveguides coupled to a second plurality of coupling ports equally spaced around the second junction; and propagating electromagnetic radiation corresponding to the third frequency band to the third junction through a third plurality of rectangular waveguides coupled to a third plurality of coupling ports equally spaced around the third junction.

25. The method recited in claim 24, wherein each of said coupling ports propagates electromagnetic radiation to the respective junction corresponding to a different phase of the respective frequency band.

26. The method recited in claim 24, further comprising simultaneously transmitting a fourth frequency band with the fourth cylindrical waveguide, wherein said transmitting comprises propagating electromagnetic radiation corresponding to the fourth frequency band through a flange coupled to the fourth waveguide.

27. The method recited in claim 26, further comprising positioning a dielectric loading rod within the fourth waveguide, wherein said positioning adjusts the frequency band transmitted by the fourth waveguide.

28. A method for propagating electromagnetic radiation, the method comprising:

propagating electromagnetic radiation along the length and along parts of the length of an antenna feed, wherein the antenna feed comprises a plurality of concentric cylindrical waveguides coaxially arranged and having decreasingly smaller diameters;

receiving a first frequency band with the first cylindrical waveguide;

simultaneously receiving a second frequency band with the second cylindrical waveguide;

simultaneously receiving a third frequency band with the third cylindrical waveguide;

wherein said receiving the first, second, and third frequency bands comprises:

propagating electromagnetic radiation corresponding to the first frequency band from the first cylindrical waveguide to a first junction coupled to a terminal end of the first cylindrical waveguide;

propagating electromagnetic radiation corresponding to the second frequency band from the second cylindrical waveguide to a second junction coupled to a terminal end of the second cylindrical waveguide; and propagating electromagnetic radiation corresponding to the third frequency band from the third cylindrical waveguide to a third junction coupled to a terminal end of the third cylindrical waveguide.

29. The method recited in claim 28, wherein said propagating the first, second, and third frequency bands comprises:

propagating electromagnetic radiation corresponding to the first frequency band from the first junction to a first plurality of rectangular waveguides via a first plurality of coupling ports equally spaced around the first junction;

propagating electromagnetic radiation corresponding to the second frequency band from the second junction to a second plurality of rectangular waveguides via a second plurality of coupling ports equally spaced around the second junction; and propagating electromagnetic radiation corresponding to the third frequency band from the third junction to a third plurality of rectangular waveguides via a third plurality of coupling ports equally spaced around the third junction.

30. The method recited in claim 29, wherein each of said coupling ports propagates electromagnetic radiation from the respective junction to the respective plurality of waveguides corresponding to a different phase of the respective frequency band.

31. The method recited in claim 29, further comprising simultaneously receiving a fourth frequency band with the fourth cylindrical waveguide, wherein said receiving comprises propagating electromagnetic radiation corresponding to the fourth frequency band from the fourth waveguide through a flange coupled to the fourth waveguide.

32. The method recited in claim 31, further comprising positioning a dielectric loading rod within the fourth waveguide, wherein said positioning adjusts the frequency band received by the fourth waveguide.

* * * * *